US008088720B2

(12) United States Patent
Habeeb et al.

(10) Patent No.: US 8,088,720 B2
(45) **Date of Patent: *Jan. 3, 2012**

(54) GREEN LUBRICANT COMPOSITIONS

(75) Inventors: Jacob J. Habeeb, Westfield, NJ (US); Douglas E. Deckman, Mullica Hill, NJ (US); Brandon T. Weldon, Pearland, TX (US); William L. Maxwell, Pilesgrove, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 196 days.

This patent is subject to a terminal disclaimer.

(21) Appl. No.: 12/322,790

(22) Filed: Feb. 6, 2009

(65) Prior Publication Data

US 2009/0221459 A1 Sep. 3, 2009

Related U.S. Application Data

(60) Provisional application No. 61/067,584, filed on Feb. 29, 2008.

(51) Int. Cl.
*C10M 137/06* (2006.01)
*C10M 129/74* (2006.01)

(52) U.S. Cl. ..... 508/369; 508/189; 508/370; 508/371; 508/372; 508/373; 508/390; 508/485; 508/518

(58) Field of Classification Search ..... 508/369, 508/370, 189, 390, 465, 485, 531
See application file for complete search history.

(56) References Cited

U.S. PATENT DOCUMENTS

| | | | | |
|---|---|---|---|---|
| 4,568,663 | A | 2/1986 | Mauldin | |
| 4,705,641 | A | 11/1987 | Goldblatt et al. | |
| 4,827,064 | A | 5/1989 | Wu | |
| 4,827,073 | A | 5/1989 | Wu | |
| 4,956,122 | A | 9/1990 | Watts et al. | |
| 5,021,173 | A | 6/1991 | Waddoups et al. | |
| 5,049,290 | A * | 9/1991 | Emert et al. | 508/270 |
| 5,348,982 | A | 9/1994 | Herbolzheimer et al. | |
| 5,545,674 | A | 8/1996 | Behrmann et al. | |
| 5,739,089 | A | 4/1998 | Colclough | |
| 6,034,038 | A | 3/2000 | Lockwood et al. | |
| 2004/0110104 | A1 | 6/2004 | Guinther et al. | |

FOREIGN PATENT DOCUMENTS

| | | |
|---|---|---|
| EP | 0 277 729 B1 | 8/1988 |
| EP | 0 317 354 B1 | 5/1989 |
| WO | WO 2005/111179 A1 | 11/2005 |

OTHER PUBLICATIONS

Vipper, A. B., et al., "The interaction between zinc dithiophosphates [(ZDTP)] and oil soluble metal salts [with respect to their antiwear properties in lubricants] Wechselwirkung zwischen Zinkdithiophosphaten und oelloeslichen Metallsalzen", *Tribologie & Schmierungstechnik*, V41, N.3, 135-137 (May-Jun. 1994) (Abstract Only).

Wallfahrer, U., "Polymer esters and their synergy with ZDDP [Zinc dithiodialkylphosphate)] . . . A possibility to reduce ZDDP content in lubricants?", Technische Akademie Esslingen 9$^{th}$ International "Ecological & Economic Aspects of Triboloby" Colloquiun (Esslingen 1/11-13/94) Proceedings, V2 11.14-1-11.14-10 (1994) (Abstract Only).

* cited by examiner

*Primary Examiner* — Ellen McAvoy
*Assistant Examiner* — Taiwo Oladapo
(74) *Attorney, Agent, or Firm* — Lisa Montalvo; Robert A. Migliorini

(57) ABSTRACT

The present invention is directed to method of making a green lubricant composition having improved wear protection and reduced phosphorus emissions.

5 Claims, 1 Drawing Sheet

GREEN LUBRICANT COMPOSITIONS

This application claims priority of Provisional Application 61/067,584 filed Feb. 29, 2008.

FIELD OF THE INVENTION

The present invention relates to a method of making lubricant compositions having improved wear protection and reduced phosphorus emissions.

BACKGROUND OF THE INVENTION

Zinc dialkyldithiophosphate (ZDDP) has been used as an additive in formulated crankcase lubricants in motor vehicles for many decades. The primary function of ZDDP is to provide antiwear protection to moving engine parts by interacting with iron oxides to form a protective layer.

The current understanding of the formation of antiwear films from ZDDP involves tribochemical and thermooxidative components. As ZDDP decomposes, metathiophosphates and colloidal polyphosphates are formed. The decomposition of these materials leads to the formation of low molecular weight volatile phosphorus compounds. This occurs because ZDDP is not ash-free and contains phosphorus.

Despite the advances in lubricant oil formulation technology, there remains a need for lubricant oil compositions that provide environmentally beneficial properties such as reduced exhaust emissions in motor vehicle engines, specifically, reduced phosphorus emissions.

The present invention provides a synergistic combination of ZDDP and other additives that result in the formation of transient intermediates that provide reduced additive volatility in motor vehicle engines.

SUMMARY OF THE INVENTION

The present invention is directed to a method of making lubricant compositions having improved wear protection and reduced phosphorus emissions in motor vehicle engines.

In one embodiment, the invention is directed to a method of making a lubricant composition having reduced phosphorus emissions comprising premixing effective amounts of a ZDDP and one or more additives; and, adding the premixed composition to a base oil. By "premixed" it is meant that at least two additives are mixed together and heated before being added to a base oil.

In another embodiment, there is provided a method of making a lubricant composition having reduced phosphorus emissions in motor vehicle engines comprising premixing effective amounts a ZDDP, an ester and one or more additives; and, adding the premixed composition to a base oil.

In yet another embodiment, there is provided a method for improving wear protection and reducing phosphorus emissions in a lubricant composition comprising adding to a lubricating base oil premixed additives comprising effective amounts of ZDDP and one or more additives.

All proportions given in this specification are based on the total mass of the final lubricant composition, including the mass of any additional constituents not specifically discussed.

Other aspects and advantages of the present invention will become apparent from the detailed description that follows.

DETAILED DESCRIPTION OF THE INVENTION

Figure 1:
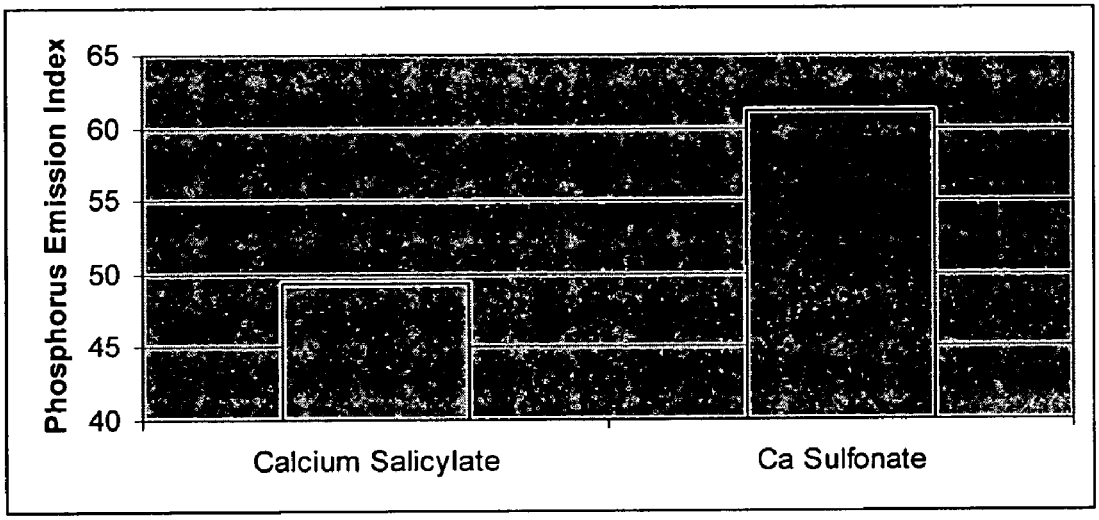
FIG. 1 is a bar graph of the phosphorous emission indices of oils formulated with calcium salicylate detergent and calcium sulfonate detergent.

It has now been found that lubricating compositions comprising a major amount of a base oil and effective amounts of premixed additives comprising ZDDP and one or more additives provide reduced phosphorus emissions and thereby improved wear protection.

Base Oil

Basestocks may be made using a variety of different processes including but not limited to distillation, solvent refining, hydrogen processing, oligomerisation, esterification, and rerefining. API 1509 "Engine Oil Licensing and Certification System" Fourteenth Edition, December 1996 states that all basestocks are divided into five general categories: Group I contain less than 90% saturates and/or greater than 0.03% sulfur and have a viscosity index greater than or equal to 80 and less than 120; Group II contain greater than or equal to 90% saturates and less than or equal to 0.03% sulfur and have a viscosity index greater than or equal to 80 and less than 120; Group III contain greater than or equal to 90% saturates and less than or equal to 0.03% sulfur and have a viscosity index greater than or equal to 120; Group IV are polyalphaolefins (PAO); and Group V include all other basestocks not included in Group I, II, III or IV. The test methods used in defining the above groups are ASTM D2007 for saturates; ASTM D2270 for viscosity index; and one of ASTM D2622, 4294, 4927 and 3120 for sulfur. Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

Formulated lubricant compositions comprise a mixture of a base stock or a base oil and at least one performance additive. Usually, the base stock is a single oil secured from a single crude source and subjected to a single processing scheme and meeting a particular specification. Base oils comprise at least one base stock. The base oil constitutes the major component of the lubricating oil composition and typically is present in an amount ranging from about 50 wt. % to about 99 wt. %, e.g., from about 85 wt. % to about 95 wt. %, based on the total weight of the composition.

The lubricating base oils of the present invention may be selected from the group consisting of natural oils, petroleum-derived mineral oils, synthetic oils and mixtures thereof boiling in the lubricating oil boiling range.

The base oils of the present invention typically include those oils having a kinematic viscosity at 100° C. in the range of 2 to 100 cSt, preferably 4 to 50 cSt, more preferably about 8 to 25 cSt.

Natural oils include animal oils, vegetable oils (castor oil and lard oil, for example), and mineral oils. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example).

Polyalphaolefins (PAOs) base stocks are commonly used as synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are herein incorporated by reference.

Unconventional base stocks include one or more of a mixture of base stock(s) derived from one or more Gas-to-Liquids (GTL) materials. GTL base oil comprise base stock(s) obtained from a GTL process via one or more synthesis, combination, transformation, rearrangement, and/or degradation deconstructive process from gaseous carbon containing compounds. Preferably, the GTL base stocks are derived from the Fischer-Trospch (FT) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and suitable catalysts in U.S. Pat. No. 4,568,663, each of which is incorporated herein by reference.

GTL base stock(s) are characterized typically as having kinematic viscosities at 100° C. of from about 2 cSt to about 50 cSt. The GTL base stock(s) and/or other hydrodewaxed, or hydroisomerized/cat (or solvent) dewaxed wax derived base stock(s) used typically in the present invention have kinematic viscosities in the range of about 3.5 cSt to 7 cSt, preferably about 4 cSt to about 7 cSt, more preferably about 4.5 cSt to 6.5 cSt at 100° C. The GTL base stock(s) are also characterized typically as having viscosity indices of 80 or greater, preferably 100 or greater, and more preferably 120 or greater.

There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Antiwear Agent

Metal dithiophosphates represent a class of additives which are known to exhibit antioxidant and antiwear properties. The most commonly used additives in this class are the zinc dialkyldithiophosphates (ZDDP) which provide excellent oxidation resistance and exhibit superior antiwear properties. ZDDPs are the preferred phosphorus compounds in the present invention. Treat levels for ZDDP in engine oils are generally expressed as the amount of phosphorus delivered to the oil, wt. % P. Preferably, ZDDP is present as phosphorus in the range from about 100 to 10,000 ppm by weight, more preferably from about 200 to 5,000 ppm by weight, most preferably from about 400 to 1,000 ppm by weight. The ZDDP may be primary or secondary or mixed primary/secondary compounds. ZDDP may also be a neutral ZDDP or an overbased ZDDP.

Detergents

Detergents useful in the present invention include the normal, basic or overbased metal, that is calcium, magnesium and the like, salts of petroleum naphthenic acids, petroleum sulfonic acids, alkyl benzene sulfonic acids, alkyl phenols, alkylene bis-phenols, oil soluble fatty acids. The preferred detergents are the normal or overbased calcium or magnesium salicylates, carboxylates, sulfonates and or phenates, most preferred detergents include normal or overbased calcium or magnesium salicylates. Detergents are used generally in amounts from about 0.01 to about 6 wt %, more preferably from about 0.01 to about 4 wt %, most preferably from about 1 wt % to about 3.0 wt %, based on the total weight of the lubricant composition.

Friction Modifiers

Friction modifiers and fuel economy agents may also be used. Examples include esters formed by reacting carboxylic acids and anhydrides with alkanols such as glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether mines, for example, ethoxylated tallow amine and ethoxylated tallow ether amine. The amines may be used as such or in the form of an adduct or reaction product with a boron compound such as a boric oxide, boron halide, metaborate, boric acid or a mono-, di- or trialkyl borate. Preferably the friction modifier used is a borated amine. Friction modifiers may be present in an amount ranging from about 1 to 5 wt %, more preferably from about 2 to 4 wt %, based on the total weight of the lubricant composition.

Esters

Useful esters of the present invention include the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic add, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols e.g. neopentyl glycol, trimethylol ethane, 2-methyl-2-propyl-1, 3propanediol, trimethylol propane, pentaerythritol and dipentaerythritol with alkanoic adds containing at least 4 carbon atoms such as the, normally the $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid.

The most suitable synthetic ester oils are the esters of trimethylol propane, trimethylol butane, trimethylol ethane, pentaerythritol and/or dipentaerythritol with one or more monocarboxylic acids containing from about 5 to about 10 carbon atoms are widely available commercially, for example, the Mobil P-41 and P-51 esters (Mobil Chemical Company).

In general, the ester used will have a viscosity at 100° C. in the range of about 2 to about 4 cSt and preferably about 2.5 to about 3.5 cSt. Preferably, the ester is a tetramethyl propionate polyol ester. The esters of the present invention may be present in amounts ranging from about 1 wt % to about 95 wt %, more preferably in amounts ranging from about 5 wt % to about 75 wt %, most preferably in amounts ranging from about 10 wt % to about 50 wt %, based on the total weight of the lubricant composition.

Typical Additive Amounts

The lubricant composition of the present invention may also comprise at least one additional additive. The additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in Table 1 below, as well as other amounts mentioned in this patent, are directed to the amount of active ingredient (that is the non-solvent portion of the ingredient). The wt % indicated below are based on the total weight of the lubricant composition.

TABLE 1

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Supplementary Antioxidant | 0.0-5 | 0.0-1.5 |
| Corrosion Inhibitor | 0.01-5 | 0.01-1.5 |
| Anti-wear Additive | 0.01-6 | 0.01-4 |

TABLE 1-continued

Typical Amounts of Various Lubricant Oil Components

| Compound | Approximate Wt % (Useful) | Approximate Wt % (Preferred) |
|---|---|---|
| Pour Point Depressant | 0.0-5 | 0.01-1.5 |
| Anti-foam Agent | 0.001-3 | 0.001-0.15 |
| Base Oil | Balance | Balance |

The present invention provides for heating a mixture of at least two additives before adding the mixture of additives to a base oil. Preferably, the premixed additives are heated to a temperature ranging from about 30° C. to about 80° C.

The following non-limiting examples are provided to illustrate the invention.

Examples 1-8

Examples 1 through 8 are set forth in Table 1 where the amount of phosphorus loss is measured using inductively coupled plasma emission spectrometry. The error of reproducibility is ±0.0001. A ZDDP and an ester were premixed, stirred and heated to about 40° C. The premixed additives were then added to a Group III base stock that had been heated to 40° C. and stirred. For comparative purposes, lubricant compositions were prepared according to what is known in the art, that is, a Group III base stock was heated to about 40° C. and stirred. To the basestock was added a ZDDP and an ester. Each additive was blended into the basestock before adding the subsequent additive. The mixtures of ZDDP, ester and Group III base stock were then heated to 170° C. for thirty minutes in a round bottom flask fitted with a coldwater condenser. Two forms of ZDDP were used: a secondary ZDDP (isopropyl/4-methyl-2-pentyl), commercially available from the Lubrizol Corporation and a mixed secondary/primary ZDDP (85% Secondary/15% Primary), commercially available from Infineum. All samples contained ZDDP in the amount of about 0.1 wt. % P. The concentration of ZDDP is expressed as the amount of phosphorus, P, delivered to the oil, wt. % P. The ester used was a tetramethyl propionate polyolester.

TABLE 2

| Sample | Mixture | ZDDP Type | Wt % P at 40° C. (after 30 minutes) | Wt % P after heating to 170° C. (after 30 minutes) | Wt % P Loss (NO Premixing) | Wt % P Loss Premixing) |
|---|---|---|---|---|---|---|
| 1 | ZDDP Ester | Secondary ZDDP | 0.1080 | 0.0898 | 16.8 | |
| 2 | ZDDP Group III basestock | Secondary ZDDP | 0.1094 | 0.0701 | 35.9 | |
| 3 | ZDDP Group III basestock 5 wt % ester | Secondary ZDDP | 0.1100 | 0.0750 | 32.2 | |
| 4 | ZDDP Group III basestock 5 wt % ester | Secondary ZDDP | 0.1100 | 0.0866 | — | 21.3 |
| 5 | ZDDP Ester | Mixed Secondary/ Primary | 0.0981 | 0.0807 | 17.7 | |
| 6 | ZDDP Group III basestock | Mixed Secondary/ Primary | 0.0973 | 0.0690 | 29.1 | |

TABLE 2-continued

| Sample | Mixture | ZDDP Type | Wt % P at 40° C. (after 30 minutes) | Wt % P after heating to 170° C. (after 30 minutes) | Wt % P Loss (NO Premixing) | Wt % P Loss Premixing) |
|---|---|---|---|---|---|---|
| 7 | ZDDP Group III basestock 5 wt % ester | Mixed Secondary/ Primary | 0.0978 | 0.0706 | 27.8 | |
| 8 | ZDDP Group III basestock 5 wt % ester | Mixed Secondary/ Primary | 0.0978 | 0.0835 | — | 14.6 |

The unexpected benefit of premixing the ZDDP with the ester is demonstrated in Table 2. Phosphorus retention increases by more than 30% when premixing an ester with a secondary ZDDP and by more than 40% when premixing an ester with a mixed ZDDP. By improving the amount of phosphorus retained in the oil, the antiwear properties of the lubricant composition are maintained and most importantly, phosphorus emissions into the environment are reduced.

Examples 9-14

The procedure of examples 1-8 was followed except that a fully formulated 0W30 oil having a kinematic viscosity at 100° C. of 11 cSt was used. The effects of premixing the ester with the ZDDP prior to mixing with the oil and its other components are demonstrated in Table 3. The ZDDP used was a mixed secondary/primary ZDDP (85% Secondary/15% Primary), commercially available from Infineum. All samples contained ZDDP in the amount of 0.08 wt. % P. The concentration of ZDDP is expressed as the amount of phosphorus, P, delivered to the oil, wt. % P. The ester used was a tetramethylpropionate polyolester. Phosphorus loss was measured using inductively coupled plasma emission spectrometry. The error of reproducibility is ±0.0001.

As is demonstrated in Table 3, there is a significant reduction in phosphorus loss when the ZDDP and the ester are premixed. At a concentration of 5 wt. % ester, the phosphorus loss is reduced by about 10%; at 10 wt. % ester, the phosphorus loss is reduced by about 20%.

Example 15

A series of 0W-30 fully formulated oils having a kinematic viscosity at 100° C. of 11 cSt were formulated with ZDDP in the amount of 0.08 wt % P. The concentration of ZDDP is expressed as the amount of phosphorus, P, delivered to the oil, wt. % P. The oils were evaluated in the Sequence IIIG engine test conducted pursuant to ASTM D7320, which is incorporated herein by reference. Phosphorus retention was measured. Phosphorus retention is defined as 100*ΔP/ΔCa (%) where $\Delta P=[P]_{end\ of\ test}/[P]_{initial}$ and $\Delta Ca=[Ca]_{end\ of\ test}/[Ca]_{initial}$. Phosphorus and Calcium were measured according to ASTM D5185, which is herein incorporated by reference. A high phosphorus retention value indicates that phosphorus remains in the crankcase and therefore can not degrade the 3-way emission catalysts. The impact of the tetramethyl propionate polyolester at varying concentrations is shown in

TABLE 3

| Sample | Ester Concentration | Type | Wt % P at 40° C. (after 30 minutes) | Wt % P after heating to 170° C. (after 30 minutes) | Wt % P Loss (No Premixing) | Wt % P Loss (No Premixing) |
|---|---|---|---|---|---|---|
| 9 | 0.0 wt % Ester | Mixed Secondary/ Primary | 0.0790 | 0.0650 | 17.7 | — |
| 10 | 0.0 wt % Ester | Mixed Secondary/ Primary | 0.0790 | 0.0650 | — | 17.7 |
| 11 | 5.0 wt % Ester | Mixed Secondary/ Primary | 0.0790 | 0.0684 | 15.3 | — |
| 12 | 5.0 wt % Ester | Mixed Secondary/ Primary | 0.0790 | 0.0669 | — | 13.4 |
| 13 | 10.0 wt % Ester | Mixed Secondary/ Primary | 0.0790 | 0.0710 | 12.9 | — |
| 14 | 10.0 wt % Ester | Mixed Secondary/ Primary | 0.0790 | 0.0688 | — | 10.1 |

Table 4. Phosphorus retention significantly improves with the increase of the ester concentration.

TABLE 4

| | Ester Level, wt % | | | | | | |
|---|---|---|---|---|---|---|---|
| | 0 | 0 | 0 | 0 | 10 | 24.1 | 30 |
| P Retention, % | 85.0 | 84.2 | 86.9 | 84.8 | 87.2 | 90.0 | 92.3 |

Example 16

A series of fully formulated passenger car engine oils were formulated with ZDDP in the amount of 0.045 wt % P. The concentration of ZDDP is expressed as the amount of phosphorus, P, delivered to the oil, wt. % P. The phosphorus retention performance as measured in the Sequence IIIG engine test, ASTM D7320, was determined. Detergents were added to the formulation. The detergents used were calcium salicylate, magnesium salicylate and magnesium sulfonate in the amount of about 2.0 wt %. As is demonstrated in Table 5, calcium salicylate detergents provide a significant benefit in phosphorus retention over magnesium sulfonate or magnesium salicylate detergents. And when calcium salicylate detergents are combined with a borated amine friction modifier, a further improvement in phosphorus retention is obtained.

TABLE 5

| | | | | |
|---|---|---|---|---|
| Borated Amine Friction Modifier, wt % | 0 | 0 | 0 | 2.20 |
| Detergent, wt % | 1.55 Mg Sulfonate | 1.87 Mg Salicylate | 3.0 Ca Salicylate | 3.0 Ca Salicylate |
| Phosphorus Retention, % | 77.9 | 81.2 | 87.1 | 93.0 |

Example 17

An additional experiment compared the impact of detergent type on phosphorus emission index. In this experiment, volatilities from a Noack apparatus run at 165° C. for 16 hours were collected and the milligrams (mgs) of phosphorus captured was determined. This quantity is multiplied by a scaling factor (13.08) to yield a phosphorus emission index. The scaling factor converts the mgs of phosphorus captured to mg of phosphorus volatilized per quart of sample, assuming a density of 0.85 g/mL. Using this methodology, a low result is desired. Two SAE 0W-30 fully formulated oils having a kinematic viscosity at 100° C. of 11 cSt were compared which differed only in the detergent system used. The oil formulated with calcium salicylate detergent was found to have significantly lower phosphorus emissions than the oil formulated with calcium sulfonate detergent. The phosphorus emission indices were 49.4 and 61.2, respectively. The results are presented in FIG. 1.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall therebetween.

What is claimed is:

1. A method of making a lubricant composition having improved wear protection and reduced phosphorus emissions comprising premixing additives comprising effective amounts of ZDDP, a polyol ester having a viscosity of 100° C. in the range of about 2 to about 4 cSt and at least one additional additive; heating the ZDDP, the polyol ester and the least one additional additive in the temperature range of about 30° C. to about 80° C.; and, adding said premixed additives to a major amount of base oil, wherein the ZDDP is selected from the group consisting essentially of primary ZDDPs, secondary ZDDPs and mixtures thereof and wherein said polyol ester is a tetramethyl propionate polyolester.

2. The method of claim 1, wherein said at least one additional additive is a detergent selected from a calcium salicylate, magnesium salicylate or magnesium sulfonate.

3. The method of claim 2, wherein said detergent is a calcium salicylate.

4. The method of claim 1, wherein said at least one additional additive is a borated amine friction modifier.

5. In the method of preparing a lubricant composition in which effective amounts of ZDDP, a polyol ester and one or more additional additives are added to a base oil, the improvement comprising premixing ZDDP and a polyol ester having a viscosity at 100° C. of from about 2 to about 4 cSt; heating the premixed additives from about 30° C. to about 80° C.; and, thereafter adding the additives to the base oil, wherein the ZDDP is selected from the group consisting essentially of primary ZDDPs, secondary ZDDPs and mixtures thereof and wherein said polyol ester is a tetramethyl propionate polyolester, whereby said lubricant composition has improved wear and reduced phosphorous emission properties.

* * * * *